United States Patent [19]

Wenderott et al.

[11] 3,998,663

[45] Dec. 21, 1976

[54] WORKABLE NICKEL MATERIAL AND PROCESS FOR MAKING SAME

[75] Inventors: Berthold Wenderott; Gerhard Kohlert, both of Altena, Germany

[73] Assignee: Vereinigte Deutsche Metallwerke AG, Frankfurt am Main, Germany

[22] Filed: Jan. 22, 1975

[21] Appl. No.: 542,932

[30] Foreign Application Priority Data

| | | |
|---|---|---|
| Jan. 30, 1974 | Germany | 2404256 |
| May 24, 1974 | Germany | 2425271 |
| Aug. 9, 1974 | Germany | 2438381 |

[52] U.S. Cl. ..... 148/2; 29/527.7; 75/170; 148/11.5 N; 148/32

[51] Int. Cl.[2] ..... C22F 1/10

[58] Field of Search ..... 148/32, 2, 11.5 F, 11.5 N; 75/170, 171; 29/527.7

[56] References Cited

UNITED STATES PATENTS

| | | | |
|---|---|---|---|
| 3,622,234 | 11/1971 | Seybolt et al. | 75/171 |
| 3,749,569 | 7/1973 | Starr et al. | 75/170 |

*Primary Examiner*—R. Dean

*Attorney, Agent, or Firm*—Karl F. Ross; Herbert Dubno

[57] ABSTRACT

A workable nickel material is made by forming a melt consisting essentially of 0.01 to 0.15% by weight oxygen, elements having an affinity for oxygen defined as the negative numerical value of the enthalpy of formation of the corresponding oxide in Kcal/mole which does not exceed 92 Kcal/mole in an amount homogeneously mixable with nickel, 0 to 0.3% manganese, cerium or rare earth elements in an amount up to that which will combine with up to 20% (e.g. 10 to 20%) by weight of the oxygen, balance nickel, and adjusting the oxygen content to that level. The melt is cast to form an ingot which is worked to destroy the nickel-nickel oxide eutectic structure and to dispense the nickel oxide in the metal. The result is a highly workable nickel material containing a high proportion of nickel oxide.

4 Claims, No Drawings

WORKABLE NICKEL MATERIAL AND PROCESS FOR MAKING SAME

FIELD OF THE INVENTION

This invention relates to the production and use of a workable nickel material.

BACKGROUND OF THE INVENTION

A material is generally described as being workable if it can be cold worked and hot worked. Nickel materials are usually hot workable. A nickel material which is sufficiently cold workable can be produced by a method which is based on the conventional processes of ferrous metallurgy and in which the molten material is degasified. This is accomplished by the known boiling reaction, which results from the formation of carbon monoxide in the molten material. Depending on the initial analysis of the molten material, the formation of CO is caused by an addition of carbon or of oxygen, the latter mainly in the form of metal oxides. This step enables also an adjustment of a predetermined carbon or oxygen content.

Because the reaction, $$C + NiO - CO + Ni$$

as an equilibrium reaction never results in a quantitative formation of CO, an undesirably high residual content of oxygen will always remain in the molten material, depending on various parameters, such as temperature and the slagging. This residual oxygen must be removed as completely as possible by an addition of elements which have an affinity to oxygen, such as magnesium, aluminum, manganese, silicon and in some cases also lithium and titanium. Because this oxygen-removal technique also involves equilibrium reactions, a surplus of the elements having an affinity for oxygen must be added if the deoxidation is to be as complete as possible. Whereas in a deoxidation with carbon the reaction product escapes as a gas, a considerable part of the reaction products formed by the deoxidation with metals having an affinity for oxygen remains in the molten materials as exogenous oxides. These deoxidation residues may give rise to considerable difficulties during the further processing of the nickel materials and during the use thereof by the final consumer.

For instance, elevated temperatures during the final processing or during the subsequent use of the nickel material may cause metallic residues of deoxidizers to diffuse out so that solderability or, in parts used in vacuum technology, the production of high vacuums will be highly adversely affected. Such metallic residues of deoxidizers will also be disturbing if the part is to be sealed in fused glass or is to be enamelled, mainly because such metallic residues of deoxidizers in contact with elements having high vapor pressures (Pb, Zn) result in an undesirably high porosity. Such elements are present in most of the contacting materials referred to. Similar remarks are applicable to the residual carbon which is still contained in nickel materials made by known processes and which reacts with such elements to form CO so that blowholes are produced in the surface layer.

Regardless of the size of the ingot, nickel materials made in the conventional manner from molten materials which have been deoxidized have the further disadvantage that certain exogenous oxides deposit at the grain boundaries and may give rise to stress crack corrosion in highly corroding environments under high mechanical stresses, particularly in contact with caustic alkaline solutions at elevated temperatures.

OBJECTS OF THE INVENTION

It is an object of the invention to provide, for the production of a workable nickel material, a process with which the above-mentioned disadvantages can be avoided.

Another object is to provide an improved nickel material of high workability.

Still another object of the invention is to provide improved articles composed of nickel materials.

DESCRIPTION OF THE INVENTION

It has surprisingly been found that these objects can be accomplished in that molten material which consists of 0.01–0.15% oxygen, balance nickel, is cast to form an ingot, which is subsequently hot-formed to destroy the nickel-nickel oxide eutectic system and to finely disperse the nickel oxide in the metallic structure.

The production process according to the invention differs from the previous practice in that the molten material is not deoxidized but a predetermined oxygen content is adjusted so that it is ensured that the ingot is free of exogenous oxides, free of readily vaporizable metals which have an affinity for oxygen, and free of carbon, which is not present owing to the relatively high oxygen content of the molten material. The remarks just made in connection with carbon are also applicable to hydrogen, which in the previous practice has a fairly high solubility in liquid nickel and has given rise to various difficulties. When the oxygen content is adjusted in accordance with the invention, any hydrogen contained in the molten material is transformed into water vapor, which is not soluble in nickel. Ingots cast according to the invention pipe in the desired manner because of a rising of the ingot made from deoxidized molten materials (water vapor, agitation due to CO) have been eliminated. Whereas it is generally sufficient to adjust an oxygen content of 0.01–0.15% by weight for making the desired workable nickel materials, it may be desirable in some cases to adjust the oxygen content within a narrower range and to use a molten material which contains 0.02–0.12% by weight oxygen.

Whereas nickel materials are usually hot-worked at temperatures of 950°–1150° C, it has been found that a hot working which begins at about 1150° C and is terminated below 800° C, down to 750° C, is particularly desirable for the destruction of the nickel-nickel oxide eutectic structure and for the fine dispersion of the nickel oxide in the metallic structure.

The process according to the invention may also be used with alloys of nickel which contain 0.01–0.15% by weight, preferably 0.02–0.12% by weight oxygen and which also contains elements whose affinity for oxygen, defined as the negative numerical value of the enthalpy of formation of the corresponding oxide in kcal/mole, does not exceed that of manganese (92 kcal/mole MnO) in amounts which can be homogeneously mixed with nickel. These elements are thus present in an amount ranging from zero to an amount corresponding to the maximum which can be homogeneously mixed with nickel.

This result has led in the production of pure nickel and copper-nickel alloys to a special modification, in which the molten material contains 0.01–0.15% by weight oxygen and 0.05–0.3% by weight, preferably 0.1–0.2% by weight manganese because a small content of metallic manganese in the alloy results in the formation of mixed nickel-manganese oxides which are characterized by the fact that they are particularly finely dispersed in the structure and have a particularly desirable influence on the hot-working and cold-working properties and do not adversely affect technological properties of the alloy. Surprisingly, alloys containing such mixed oxides have an unchanged elongation to break, improved deep drawing qualities, and a distinctly increased strength.

Owing to the composition and processing according to the invention, all nickel materials mentioned above are eminently suitable for the manufacture of semifinished products. They can readily be hot-worked and cold-worked in known manner. In such processes, process annealing may be desirable.

The workable nickel material according to the invention is desirable for use in the manufacture of articles which are subject to highly corrosive, thermal and mechanical stresses, such as electrodes for spark plugs. For such applications the material is suitably subjected to a final solution heat treatment at 550°–650° C for 1–3 hours.

The workable nickel material according to the invention is also eminently suitable in the manufacture of articles which are subjected to the attack of hot combination cases which contain oil ashe and vanadium pentoxide, such as gas-turbine blades. For these applications the semifinished or finished part is also desirably subjected to a solution heat treatment at 400°–600° C for 1–10 hours. The performance of the workable nickel material according to the invention may also be improved by an addition of cerium or rare earth elements for combining with part, preferably 10–20%, of the oxygen contained in the material.

In its broadest terms, therefore the solution heat treatment is carried out at a temperature of 400° C to 650° C for a period of 1 to 10 hours. The cerium and rare-earth elements can be present in an amount ranging from zero to a maximum corresponding to that which will combine with 20% of the oxygen. Hence, for an oxygen content of 0.15% by weight, the maximum content of the cerium rare-earth component is one which is equivalent to stoichiometric combination with 0.03% by weight oxygen in the form of the corresponding oxide.

In the first place, an improvement as regards manufacturing costs and melting capacity is obtained because the finishing of the molten materials, including degasification and deoxidation, can be entirely omitted in the production of nickel materials which contain oxygen in accordance with the invention. As a result, the time required from the beginning of the melting to the teeming is reduced virtually to one-half. If carbon or deoxidizer is carried into the molten material with the raw materials, the establishment of an oxygen content of 0.01–0.02% by weight or more will ensure that these elements will be expelled from the molten material. As a result, the nickel materials according to the invention are free of metallic and oxidic deoxidation residues and free of hydrogen and carbon. As a result, the abovementioned disadvantages of the conventional nickel materials made in a process which comprises a deoxidizing step are eliminated.

The nickel materials made according to the invention can be satisfactorily welded and for this reason may also be used as sheet metal elements in the construction of equipment for the chemical industry. Root seam welds to be subjected to corrosive conditions are formed by the tungsten inert-gas (TIG) arc welding process with filler materials of the present kind. The outer beads, which usually consist of several layers, may be formed by titanium- containing fillers according to German Industrial Standard DIN 1736. Wires of the nickel materials according to the invention may be butt-welded without difficulty. This is of importance for a continuous manufacturing process. Surprisingly, such wires can be butt-welded even with a tungsten filler. This is of special interest for the manufacture of incandescent bulbs because tungsten tends generally to become embrittled when welded together with other materials if the latter contain even traces of carbon.

Compared to the nickel materials of comparable quality which have been made by conventional processes, the nickel material according to the invention which contains only oxygen has a much higher electrical conductivity than the nickel materials of comparable quality which are made by conventional processes. Because the heat resistance is improved too, these materials are particularly suitable in temperature sensors and thermocouples. In combination with NiCr 10 wires, the thermo-e.m.f. produced by them at about 1000° is about 15–20% higher than in conventional Ni-NiCr thermocouples so that the accuracy of the measurement is much improved.

The thermal expansion curve of the nickel material which consists only of oxygen and nickel is much flatter in the range of 350°–450° C than conventional LC nickel. This is of significance in plants for handling molten caustic soda. The absence of carbon and residual exogenous deoxidizer elements results in a substantially improved resistance to corrosion and stress cracking in aggressive fluids while the particular working regimen is not critical as long as it results in destruction of the nickel-nickel oxide eutectic and fine depression of the nickel oxide throughout the lattice structure, we have found that the initial working (hot rolling, hot forging, hot swarging) should be carried out in at least two stages, a first resulting in a reduction of the thickness T of the ingot to an intermediate thickness $T' = 0.3T$ to $0.1T$ and a second stage results in a reduction of the thickness $T'$ to a lower level $T'' = 0.15T'$ to $0.02T'$. From the latter thickness $T''$ the material can be cold worked to any desired lesser thickness, e.g. $0.5T''$ to $0.05T''$.

SPECIFIC EXAMPLES

The invention will be explained more fully with reference to the following Examples:

EXAMPLE I

Molten nickel was first analyzed and then adjusted to an oxygen content of 0.11%. The molten material was then cast to form an ingot having an average cross-section of 560×650 mm and a weight of about 4.5 metric tons. This ingot was then hot-rolled in one heat at 1100°–790° C to form a sheet bar having a thickness of 90 mm. After a conventional intermediate processing by welding and grinding and an ultrasonic inspection, the sheet bar was hot-rolled to a thickness of 10 mm and was then blasted, pickled and subjected to an intermediate inspection and subsequently hot-rolled to the desired final thickness of 3.2 mm. This sheet metal could subsequently be cold-rolled with optional process annealing to any desired thickness down to 0.1 mm without difficulty.

2. A nickel alloy melt having a controlled oxygen content of 0.09% was cast to form an ingot having an average cross-section of 410×750 mm and a weight somewhat above 4.2 metric tons. The ingot was hot-rolled at 1100°–800° C to form a sheet bar, which had a thickness of 160 mm and which was reduced by an additional hot-rolling step to a thickness of 5 mm. This was followed by cold-rolling in a plurality of stages to a final thickness of 0.5 mm. The processing was satisfactory in this case too.

In both cases, the structure was inspected for a check. The analysis of the micrographs showed clearly that the hot-working results in a substantial destruction of the Ni-NiO eutectic structure so that the nickel oxide is finally finely dispersed throughout the metallic structure.

The excellent properties of the workable nickel material will now be explained more fully with reference to the results obtained where this material was used in spark plug electrodes.

As regards the self-cleaning property of spark plugs it has been found that for a spark plug having a given operating temperature the length of the ceramic insulator of the plug is particularly significant. The longer the ceramic insulator, the more likely will the spark plug be self-cleaning even under unfavorable operating conditions. The permissible length of the ceramic insulator is limited by the thermal conductivity of the material of the center electrode. For this reason, a material is required in the manufacture of spark plugs which has a high thermal conductivity and a high resistance to oxidation under the operating conditions. On the other hand, the material used to make electrodes for spark plugs obviously must be economical so that, e.g. silver, gold or platinum cannot be used.

Because the oxygen-containing workable nickel material has a much higher thermal conductivity than the conventional materials used in spark plugs, such as NiMn3Si or NiCr5MnSi, its use permits the provision of a much longer ceramic insulator whereas a material having intolerably high costs is not required.

The largest permissible length of the insulator body and the thermal conductivity of the electrode material are interrelated by an e-function. In the case of low thermal conductivities, an improvement thereof will result in a definite increase of the largest permissible length of the ceramic insulator. In the case of high thermal conductivities, an improvement thereof will result only in a comparatively small increase of the largest permissible length of the ceramic insulator.

This relationship is apparent from the numerical data in the following table, in which the values in brackets represent the percentage of change compared to the next lower value in the next upper line. It is clearly apparent that, e.g., the change from a conventional electrode material to the material of the invention having a thermal conductivity which is higher by 53% results in an increase of the largest permissible length of the ceramic insulator by 13%. An increase of the thermal conductivity by about 400% as a result of a change from platinum to gold increases the largest permissible length of the ceramic insulator only by 21%.

It is apparent that the use of the material according to the invention in spark plugs permits the use of a ceramic insulator having a much larger length, which is only slightly lower than the length which is permissible where platinum is used. Thus, the use of the material according to the invention permits of the use of ceramic insulators in a length which can be used only in conjunction with noble metals, which are economically intolerable.

| Material | Thermal conductivity at 500 C cal/cm-sec- C | | Length of ceramic insulator mm | |
|---|---|---|---|---|
| NiCr5MnSi | 0.065 | | 9.1 | |
| NiMn3Si | 0.095 | (46%) | 10.8 | (19%) |
| Nickel according to the invention | 0.145 | (53%) | 12.2 | (13%) |
| Platinum | 0.178 | (23%) | 12.4 | (2%) |
| Gold | 0.715 | (402%) | 15.0 | (21%) |
| Silver | 0.970 | (36%) | 15.2 | (1.5%) |

Tests have also shown that the workable nickel material to be used according to the invention is highly superior to the previously employed material as regards resistance to oxidation. This may be explained by the absence of deoxidation residue and of surplus deoxidizers. Owing to their improved self-cleaning properties and higher resistance to oxidation, spark plugs having electrodes which according to the invention are made of a workable nickel alloy which contains oxygen and certain other elements have a much longer life, which in dependence on the composition of the fuel and the resulting exhaust gases is 6–10 times longer than the life of spark plugs in which conventional materials are used.

For instance, it is recommended to replace conventional spark plugs after a run of 10,000 km. Spark plugs comprising the material according to the invention have not exhibited a measurable wear after a run of more than 50,000 km. Spark plugs which operate satisfactorily for a longer time do not only eliminate the work and costs involved in a replacement but reduce also the fuel consumption rate.

When it is intended to use the workable nickel material under particularly critical conditions, i.e. at very high temperatures and in contact with combustion gases from impure residue oils, it will be desirable to combine part of the oxygen content of the alloy, preferably 10–20% thereof, with cerium or rare earth elements. The resulting mixed oxides inhibit an undesirably large grain growth and together with the sulfur components of the combustion gases form innocuous oxysulfides.

The propelling and heating gases produced by the combustion of oil contain, as a rule, considerable quantities of alkali metal sulfates and pyrosulfates, which deposit in the form of a liquid slag layer on the parts confining the gas streams. Liquid slags of this kind can take up and are permeable to all aggressive gaseous components of the combustion gases so that these components can partly chemically combine with the slags and can substantially damage the confining parts. This corrosive attack has been observed particularly on materials and superalloys which have a high nickel content and are heat-resistant and has been referred to as catastrophic oxidation. The utilization of inexpensive residue oils is of substantial important interest. When they are burnt, the resulting slag layers may contain as much as 60% vanadium pentoxide so that the melting point of these so-called oil phases is further reduced and their aggressiveness is increased. For this reason the utilization of residue oils in steam boiler plants and in refinery furnaces has been restricted so far.

The reaction mechanism of the described corrosive attack is highly complex and has not yet been fully investigated. For this reason, only a few measures have been adopted to suppress the corrosive action and these measures have not been satisfactory. For instance, it has been proposed to admix finely ground nickel oxide to the fuel in order to increase the melting points of the slags and oil ashes and to increase the oxygen activity of the slags which deposit on the surfaces of the confining parts. Whereas this measure has been adopted with some success, the same has not proved sufficient in practice. In other test runs, aluminum-containing superalloys have been used or oils were burnt to which calcium soaps had been added. So far, decisive successes have not yet been achieved.

An aspect of the present invention is based on the concept that nickel oxide which has been found to be capable of suppressing the corrosive attack described above is provided at the endangered surfaces of the confining parts not from the gas stream but from the material of the parts. For this reason, the oxygen-containing, workable nickel material according to the invention was used, which has an oxygen content of 0.01–0.25%, preferably 0.05–0.15%. Molten nickel can take up the stated content of oxygen and can be hot-worked and cold-worked to the required extent if, in accordance with the invention, the ingot is hot-worked to destroy the nickel-nickel oxide eutectic structure and to finely disperse the nickel oxide in the metallic structure.

It has been found that the use of this material results in such a large availability of nickel oxide and such a high activity of the oxygen contained in the nickel that liquid slags or oil ashes cannot deposit on the surface of the confining parts. By the nickel oxide, which is continuously supplied to the surface out of the oxygen-containing material, these liquids are continuously transformed into solids, which are entirely innocuous according to present recognitions. Besides, the high oxygen activity of the material to be used according to the invention prevents a formation of the Ni-NiS eutectic structure, which is liquid at the operating temperatures and has rapidly destroyed confining parts made of conventional materials.

The same remarks are applicable to oxygen-containing alloys of nickel with elements which form homogeneous mixed crystals with nickel and which have an enthalpy of formation which does not exceed 90 kcal/mole. These elements include particularly cobalt, copper, manganese, and iron.

As has been mentioned above, the addition of cerium and rare earth elements extends the field of application also to cases involving particularly critical operating conditions, i.e., very high temperatures and the presence of combustion gases of impure residue oils. Because part of the oxygen content of the alloy is combined, preferably in an order of 10–20%, the alloy contains mixed oxides which prevent an undesirably large grain growth and form innocuous oxysulfides with the sulfur components of the combustion gases when the material is used in accordance with the last-discussed aspect of the invention.

Nickel differs from other metallic materials in that its capacity to dissolve oxygen substantially increases as the temperature decreases. This property is utilized when semifinished or finished parts of the material are subjected according to the invention to a solution heat treatment at 400°–600° C for 1–10 hours. By the solution heat treatment, the material is supersaturated with oxygen so that it has a particularly high oxygen activity in the aggregates subjected to corrosive attack so that the feared catastrophic oxidation and the corrosion by oil ash is suppressed at the very beginning.

Under conditions where the high-temperature strength and the creep behavior of nickel do not meet the requirements, conventional materials may be clad with the oxygen-containing nickel according to the invention. Where this is not possible, the parts may be weld-surfaced with an oxygen-containing material according to the invention, which is supplied in the form of strip or wire. In cases involving lower requirements, even the application of spray coatings of the said materials may result in considerable improvements.

We claim:

1. A process for producing a nickel material having nickel oxide dispersed therein in its ultimate state, comprising the steps of:

a. forming a melt of nickel and oxygen and adjusting the oxygen content thereof so that said melt consists essentially of 0.01 to 0.25% by weight oxygen, elements having an affinity for oxygen selected from the group which consists of manganese, copper and iron, said elements present in elemental form and in amounts up to 0.3% by weight and wherein said elements are homogeneously miscible with nickel and cerium or rare earth elements in an amount of 0 to 0.3% the amount which will combine with a maximum of 20% of the oxygen contained in the melt, balance nickel;

b. casting said melt to form an ingot containing nickel oxide and the oxide of said element in addition to elemental nickel, the nickel oxide being in a eutectic with the nickel; and c. working said ingots to destroy the nickel-nickel oxide eutectic structure and to finely disperse the nickel oxide in the metallic structure of the worked body.

2. The process defined in claim 1 wherein said oxygen is present in said melt to a maximum of 0.15% by weight.

3. The process defined in claim 1 wherein said ingot is hot worked in at least two stages including a first stage wherein its original thickness T is reduced to a thickness $T' = 0.3T$ to $0.1T$, and a second stage resulting in a reduction of the thickness $T'$ to a lower thickness $T'' = 0.15T'$ to $0.02T'$, the material being thereafter cold worked to a thickness of $0.5T''$ to $0.05T''$.

4. The process defined in claim 1, further comprising the step of:

d. solution heat-treating the worked material of step (c) at a temperature of 400° C to 650° C for a period between 1 to 10 hours.

* * * * *